US005564947A

United States Patent [19]

Ingles et al.

[11] Patent Number: 5,564,947

[45] Date of Patent: Oct. 15, 1996

[54] MOLDED SEALED METALLIC RECEPTACLE

[75] Inventors: Gerald J. Ingles, Big Rock; Mario Garritano, Oak Lawn, both of Ill.

[73] Assignee: Methode Electronics, Inc., Chicago, Ill.

[21] Appl. No.: 189,061

[22] Filed: Jan. 26, 1994

[51] Int. Cl.[6] ..... H01R 13/40

[52] U.S. Cl. ..... 439/589

[58] Field of Search ..... 439/274, 275, 439/278, 279, 587, 589, 686, 701, 903

[56] References Cited

U.S. PATENT DOCUMENTS

| | | | |
|---|---|---|---|
| 3,221,292 | 11/1965 | Swanson et al. | 439/589 |
| 3,905,672 | 9/1975 | Anhalt et al. | 439/589 X |
| 3,920,304 | 11/1975 | Bromberg | 439/589 X |
| 4,214,802 | 7/1980 | Otani et al. | 439/589 X |
| 4,368,940 | 1/1983 | Sugiura | 439/589 X |
| 5,147,222 | 9/1992 | Hotea et al. | 439/695 |
| 5,224,874 | 7/1993 | Sell | 439/736 X |

*Primary Examiner*—Khiem Nguyen
*Attorney, Agent, or Firm*—David L. Newman

[57] ABSTRACT

A molded sealable electrical connector including a shell and an insert having contacts and lead wires overmolded within the insert and engagement means to provide press fit of the insert within a shell providing for a liquid and air-tight receptacle without the use of potting. The engagement means includes projections on the insert. The insert also includes a flange and an end lip for securing the insert within the shell.

6 Claims, 4 Drawing Sheets

MOLDED SEALED METALLIC RECEPTACLE

BACKGROUND OF THE INVENTION

The present invention relates to a liquid and/or gas sealed metallic receptacle. In particular, the invention relates to a molded insert and lead wires for a sealed metallic receptacle.

Electrical connectors which are liquid and/or gas sealed are known in the art having metallic shells which receive an insert which includes lead wires and contacts. The insert is surrounded by a metallic shell. In order to seal the electrical connector, the back of the receptacle is potted with epoxy. The potting of the back of the receptacle seals the electrical connector so that there is no leakage of liquid or gas. The use of potting materials to seal the connector is time consuming and does not always provide a leak-proof seal.

It is an object of the present invention to provide a sealed receptacle which is easily assembled and provides for a completely leak-proof connector.

It is a further object of the present invention to provide a sealed receptacle having an insert which may be press fit into a shell.

It is another object of the present invention to provide a connector which contains as few parts as possible for ease of assembly and to lower manufacturing costs.

SUMMARY OF THE INVENTION

The present invention comprises a molded insert including lead wires and contacts molded therein. The insert having engaging means along the outer surface of the insert to seal the insert within a shell.

The insert comprises an elastomer overmolded onto lead wires and contacts. The insert includes a collar to stop the insertion of the insert within the shell and an end lip to secure the insert within the shell and prohibit the insert from sliding back out of the entrance of the shell. Projections also provide for a leak-proof connector.

These and other features of the invention are set forth below in the following detailed description of the presently preferred embodiments.

DETAILED DESCRIPTION OF THE PRESENTLY PREFERRED EMBODIMENTS

Figure 1:
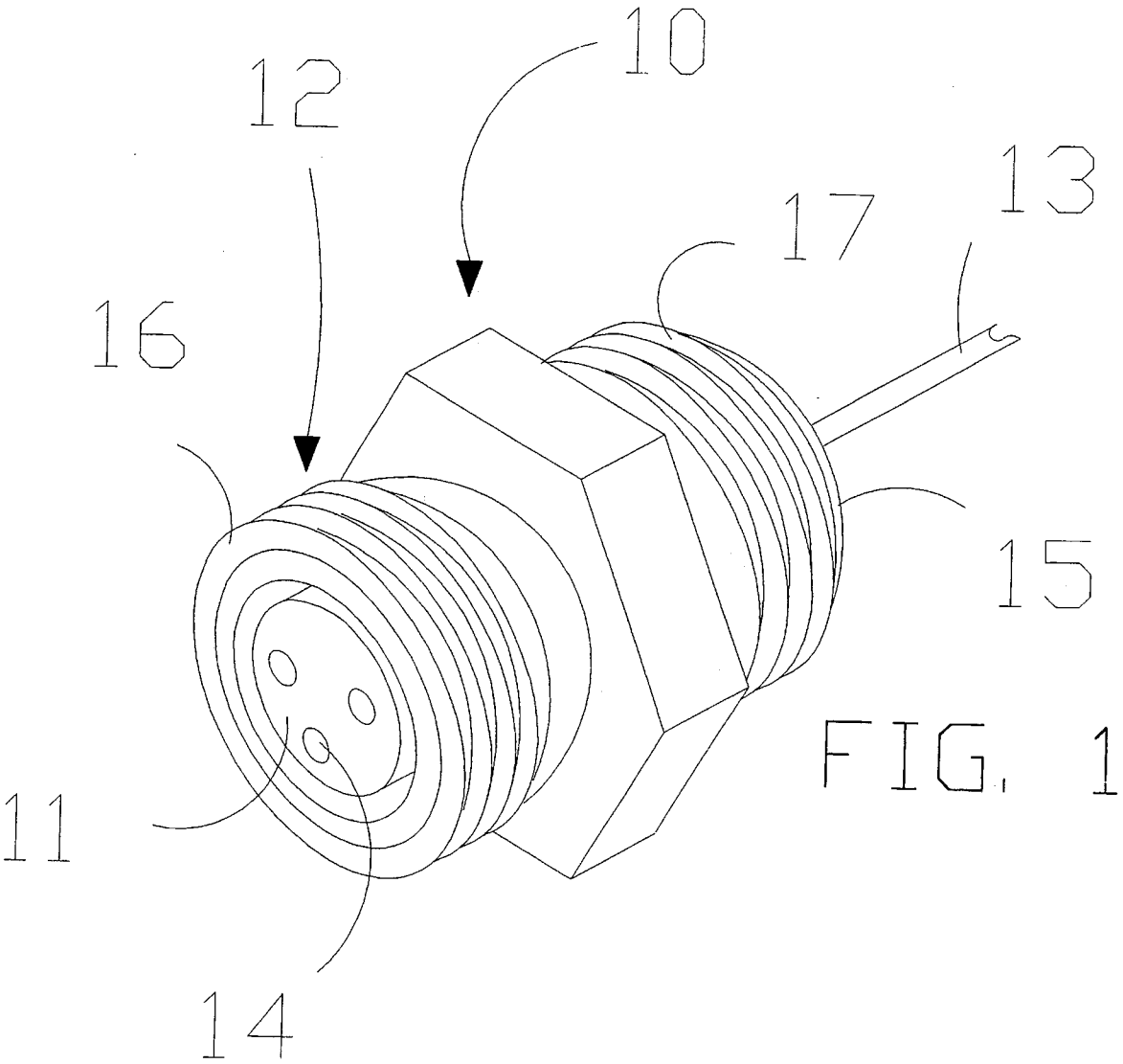
FIG. 1 is a perspective view of the assembled receptacle.

A molded sealed metallic receptacle 10 is shown in FIGS. 1–4. FIG. 1 is a perspective view of an assembled receptacle 10. The outer shell 12 is shown having insert 11 inserted within shell 12. The insert includes contacts 14 and lead wire 13 molded within the insert 11. The shell 12 in a preferred embodiment is made of a metallic material and is threaded at the front 16 and the rear 17. The end 15 of insert 11 protrudes from the rear 17 of shell 12.

Figure 2:
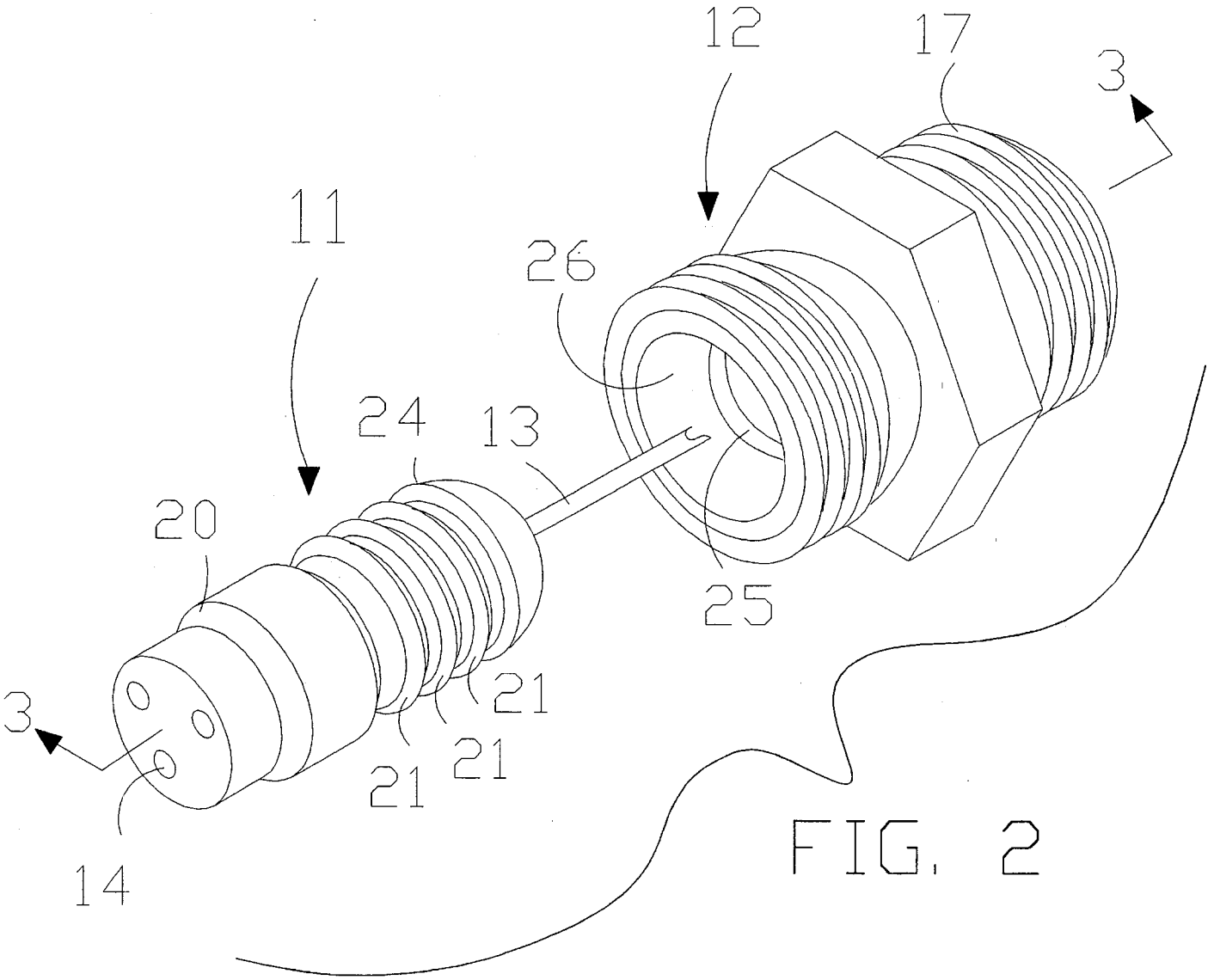
FIG. 2 is an exploded perspective view of the receptacle.

Turning to FIG. 2, shell 12 is shown separated from insert 11. FIG. 2 shows the shell 12 and insert 11 prior to assembly of the receptacle 10. Insert 11 includes contacts 14 for receiving male members of electrical connectors which may be mated to the receptacle 10. The insert 11 is overmolded onto the contacts 14 and lead wire 13. Flange 20 circumscribes the insert 11 and provides for a stop surface against the inner shoulder 25 of the shell 12. Engagement means are provided on the insert 11, via projections 21. The engagement means provide for securement of the insert 11 within the shell 12 by frictional engagement of the compressed projections 21 against the inner wall of the shell 12. The insert 11 is inserted into bore 26 of the shell 12 so that projections 21 slidingly engage the inner wall of the shell 12 until the flange 20 of the insert 11 stops against the inner shoulder 25 of shell 12. Simultaneously, end lip 24 exits the rear 17 of shell 12 and decompresses so that end lip 24 abuts against the shell 12 and retains the insert 11 therein.

Figure 3:
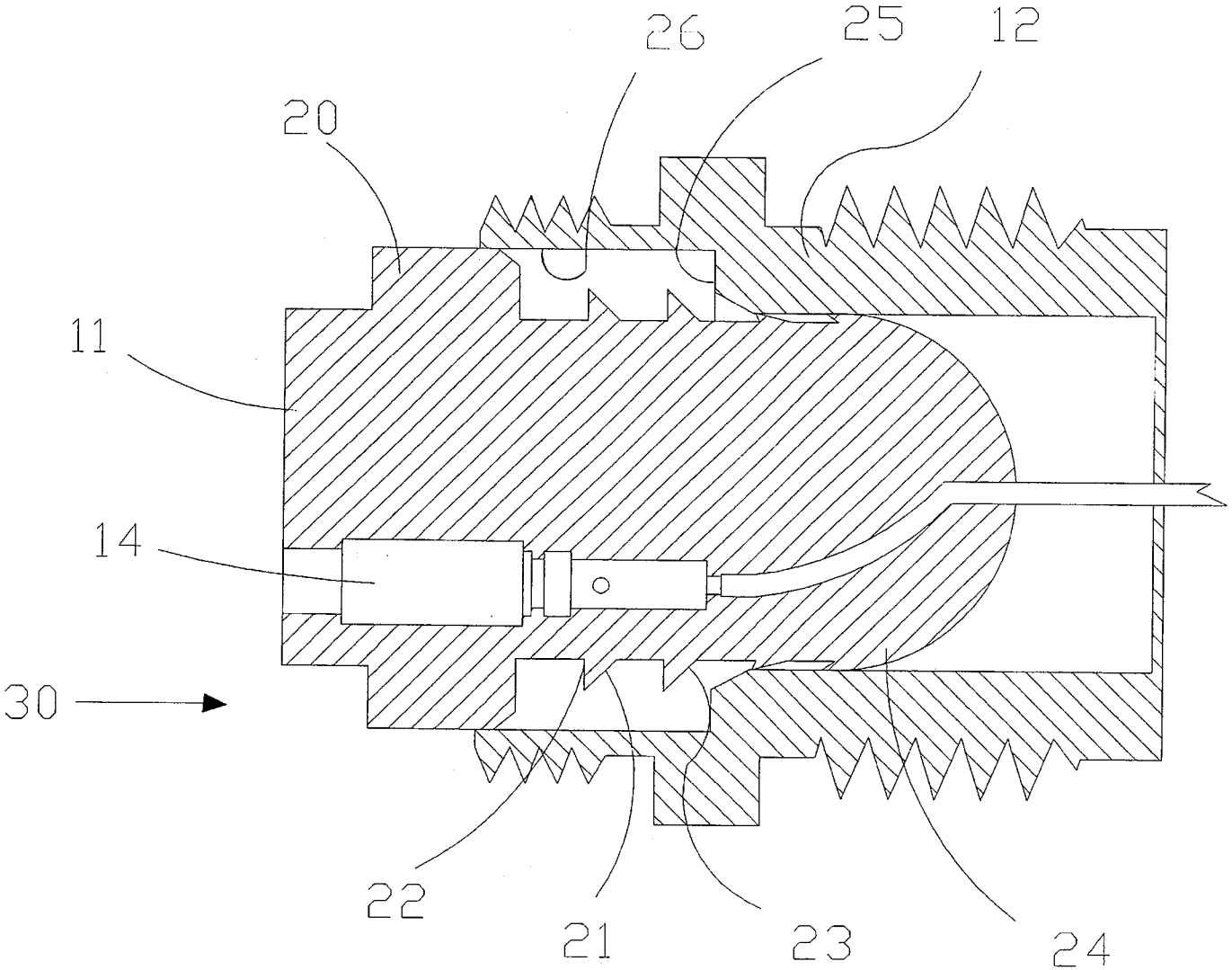
FIG. 3 is a side cut-away view of the assembly of the receptacle.

Turning to FIG. 3, a cut-away view taken at line 3—3 of FIG. 2, shows the insert 11 partially inserted within shell 12. The insert 11 is inserted in the direction of arrow 30 into shell 12. The flange 20 slidingly is inserted into bore 26. Projections 21 engage the inner wall of the shell 12 and are depressed as the insert 11 moves into the shell 12. The insert 11 is molded of an elastomer material which provides for projections 21 which may be depressed upon insertion in the shell 12. The projections 21 are shaped so that the front surface of the projection 22 is perpendicular to the movement of the insert 11 as shown by arrow 30. The rear surface 23 of projections 21 are angled to provide for less resistance for easy insertion of the insert 11 into shell 12. This allows for the insert 11 to move easily in the direction of arrow 30 into the shell 12. End lip 24 is also compressed against the inner wall of the shell 12 upon insertion of the insert 11. The insert 11 includes contacts 14 connected to lead wire 13. The insert 11 is overmolded around the contact 14 and lead wire 13. Such overmolding provides for a one-piece insert 11 which is quickly and easily assembled with the shell 12 by press fitting the insert 11 therein.

Figure 4:
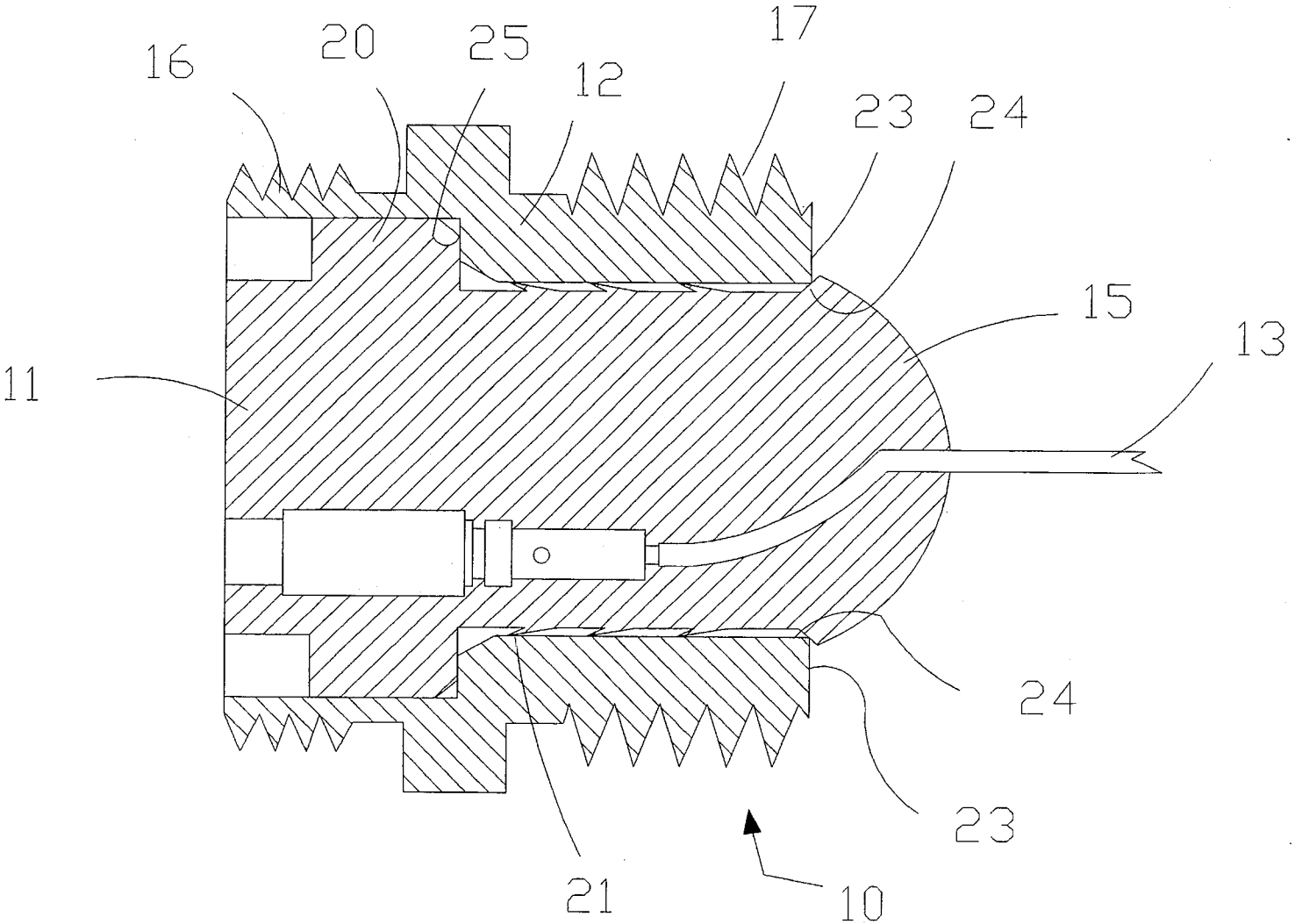
FIG. 4 is a side cut-away elevation view of the assembled receptacle taken at line 3—3 of FIG. 2.

Turning to FIG. 4, the insert 11 is shown fully mated within shell 12 (also as shown in FIG. 1). Flange 20 abuts inner shoulder 25 which prohibits the insert 11 from being inserted any further within the shell 12. End lip 24 exits the rear 17 of the shell 12 and decompresses so that the end lip 24 surrounds the rear 17 of the shell 12 and abuts against the rear surface 23 of the shell 12 to prevent the insert 11 from sliding back out of the front 16 of the shell 12. Thus, the insert 11 becomes securedly contained within the shell 12 by abutment at the front 16 of the shell 12 by flange 20 against shoulder 25 and at the rear 17 by end lip 24 against rear surface 23. End lip 24 also provides for a gas and/or liquid seal of the receptacle 10. The end 15 of the insert 11 protrudes from the rear 17 of shell 12. The insert 11 in its fully mated position having projections 21 compressed against inner wall of the shell 12 to provide for a leak-proof receptacle 10 which will prevent any air or liquids from traveling between the shell 12 and insert 11. The invention of the receptacle 10 using the molded insert 11 provides for quick and easy assembly. The receptacle 10 in the present invention provides for a water and air-tight receptacle without the use of a potting compound. The present invention provides a receptacle 10 which is less costly and easier to produce than prior receptacles. Further, the elastomer overmold material at end 15 of insert 11 provides for greater strain relief for the lead wire 13 than a prior art epoxy potting compound.

In a preferred embodiment of the invention, the assembly of the insert within a shell will provide for a leak-proof receptacle up to 12 psi. The preferred embodiment of the present invention provided for insertion force of the insert 11 within shell 12 of 120–180 lbs. and extraction forces of 76–170 lbs.

The description above has been offered for illustrative purposes only, and it is not intended to limit the scope of the invention of this application which is defined in the following claims. For example, the features provided by the presently preferred embodiments could also provide for a connector having male contacts and not just a receptacle having female contacts as disclosed above.

What is claimed is:

1. A leak-proof electrical connector comprising:

a shell; and an insert of an elastomer material overmolded onto a contact and lead wire and projections, wherein each of said projections further comprises a flat front surface and an angled rear surface for securing said insert within said shell.

2. The electrical connector of claim 1 wherein said shell is a metallic material.

3. The electrical connector of claim 1 wherein said insert includes a flange which abuts an inner shoulder of said shell.

4. The electrical connector of claim 1 wherein said insert includes an end lip to abut a rear surface of said shell upon complete insertion within said shell.

5. The electrical connector of claim 1 wherein said contact is a female contact wherein said electrical connector is a receptacle.

6. A leak-proof electrical connector comprising:

a shell;

an insert of an elastomer material, including a contact and lead wire molded within said insert and engagement means for securing said insert within said shell;

said engagement means projecting from said insert and comprising a flat front surface and an angled rear surface;

said shell is a metallic material;

said insert includes a flange which abuts an inner shoulder of said shell; and said insert includes an end lip to abut a rear surface of said shell upon complete insertion within said shell.

* * * * *